United States Patent [19]

Economopoulos et al.

[11] Patent Number: 4,931,159

[45] Date of Patent: Jun. 5, 1990

[54] INSTALLATION FOR CONTINUOUS MANUFACTURING OF AN ULTRATHIN METAL FOIL BY ELECTROLYTIC DEPOSITION

[75] Inventors: Marios Economopoulos, Liege; Nicole Lambert, Waremme, both of Belgium

[73] Assignee: Centre de Recherches Metallurgiques-Centrum Voor Research in de Metalurgie, Brussels, Belgium

[21] Appl. No.: 276,446

[22] PCT Filed: Feb. 15, 1988

[86] PCT No.: PCT/BE88/00004

§ 371 Date: Dec. 7, 1988

§ 102(e) Date: Dec. 7, 1988

[87] PCT Pub. No.: WO88/06195

PCT Pub. Date: Aug. 25, 1988

[30] Foreign Application Priority Data

Feb. 13, 1987 [LU] Luxembourg ..... 86.773

[51] Int. Cl.[5] ..... C25D 17/00

[52] U.S. Cl. ..... 204/208

[58] Field of Search ..... 204/208, 273

[56] References Cited

FOREIGN PATENT DOCUMENTS

86/119 9/1986 Luxembourg .

*Primary Examiner*—T. M. Tufariello

*Attorney, Agent, or Firm*—Fleit, Jacobson, Cohn, Price, Holman & Stern

[57] ABSTRACT

An installation for manufacturing an ultrathin foil by electrolytic deposition onto a moving cathode with eventual separation of the deposited material from the cathode is disclosed. The installation includes at least one anode having a plate perforated by a first series of orifices supplied with means of feed of electrolyte. The plate is also perforated by a second series of orifices which are suppled with means of evacuation of electrolyte. The installation of manufacturing includes the moving cathode which is comprised of a metallic belt extended taut between two parallel rolls, which are preferably horizontal. At least one of the rolls is motorized so as to cause the belt to rotate around the two rolls. A first set of the anodes is disposed facing a portion of the length of a first longitudinal run of the belt. Means of electrical connection are provided from the plate of each anode of the first set to the positive terminal of a source of continuous D.C. current. Means of electrical connection are provided from the metallic belt to the negative terminal of the source of continuous D.C. current.

Means are also provided for regulating the speed of said metallic belt, the rates of feed and removal of the electrolyte, and the intensity of the electric current.

12 Claims, 3 Drawing Sheets

INSTALLATION FOR CONTINUOUS MANUFACTURING OF AN ULTRATHIN METAL FOIL BY ELECTROLYTIC DEPOSITION

CROSS REFERENCE TO RELATED APPLICATION(S)

This U.S. application stems from PCT International Application No. PCT/BE88/00004 filed Feb. 15, 1988.

BACKGROUND OF THE INVENTION

1. Field of the Invention

The invention relates to an installation for continuous manufacturing of an ultrathin metal foil by electrolytic deposition.

2. Description of the Background Art

The technique of electrolytic deposition is known. It has been long employed to form thin metallic coatings on substrates of very diverse types. Continuous application is particularly useful for elongated products such as long strips, wires, filaments, fibers, or the like, which can be passed through the depositing apparatus. The technique allows production of:

adhering coatings which are permanently affixed to the substrate surface, as well as, non-adhering coatings, which can be detached from the substrate as independent products.

In the context of this disclosure, "fabrication of an ultrathin foil" should be understood to mean formation of a non-adhering coating in the form of an ultrathin foil forming an independent product.

In the past, it has been proposed to use a mobile substrate comprised of a rotating drum which forms the cathode of the electrolysis system and which turns while faced by an anode of appropriate configuration. The electrolyte can be circulated at high speed tangentially to the cathode in the narrow space between the anode and cathode. With this arrangement, current densities of an order of 30 A/dm$^2$ can be achieved.

Luxembourg Patent No. 86.119, held by the present applicant, discloses an apparatus which enables an electrolytic coating, particularly a non-adhering coating, to be applied on a rotating cathode. The apparatus has an anode designed to assure high turbulence of the electrolyte in the space between the anode and cathode, wherewith electrolyte is fed perpendicularly to the plane of the cathode. At the same time, excessive motive pressures are avoided. However, the apparatus of the cited Luxembourg Patent does not enable attainment of the high production levels required in industry.

The problem of devising a high speed apparatus stems particularly from the continuous nature of the process and the complexity of the techniques.

The mean thickness and width of the desired ultrathin foil will be based on the need of the user. For a given installation, these dimensions will vary between relatively narrow limits.

To increase the production rate, it is necessary to increase the speed of the substrate, and therefore generally the length of the deposition apparatus in order to maintain the same duration of deposition.

To some extent, the space required by the apparatus can be minimized by certain measures such as the use of an anode which allows higher current densities, and the employment of maximum current density and maximum throughput rate of electrolyte. There is still some increase in the length of the deposition zone that is necessary. This is the length of the zone where the electrodes essentially face each other. This increase is obtained by a simultaneous increase of the length of the anode and cathode in the direction of passage of the substrate. The length of the anode can be increased readily by juxtaposing a plurality of devices, as described in Luxembourg Patent No. 86.119.

Regarding the rotating drum-type cathode mentioned above, the desired increase in the length of the deposition zone requires the diameter of the drum to be substantially increased. However, in practice, this diameter is limited by considerations of fabrication, installation, and available space.

A solution might be to employ a plurality of apparatuses in series. However, serious drawbacks are attendant upon this. The foil leaving an intermediate apparatus is thinner than the final ultrathin foil. Any manipulation of it would increase the risk of tearing the product. Further, a thin foil below a "minimum thickness for detachability" cannot be detached from one drum, to pass to another. Accordingly, a limitation is placed on the speed of delivery of the foil. Finally, having multiple deposition apparatuses increases the cost and complexity of the installation by a substantial amount.

It is also known to employ a mobile cathode comprised of an endless metal belt passing over and rotating in a loop around two parallel rolls. Such a belt may have sufficient length that only one belt is required to enable completion of the entire deposition, even at high belt speed. This solves the problem presented by the above-mentioned drawbacks of rotating-drum cathode, but gives rise to other difficulties, particularly with regard to the length and speed of the belt. In particular, one might mention the difficulty of guiding a very long belt and the need to compensate for the catenary deformation of the suspended span. These difficulties are further complicated by the aggressive character of the ambient medium. Such an installation is also subject to problems of sealing and problems of retardation of the belt, the latter due to the fact that electricity is supplied to the belt by brushes.

The underlying problem solved by the present invention is to devise an installation for continuous manufacturing of an ultrathin foil by electrolyte deposition of a non-adhering coating onto a moving substrate, followed by removal of the coating, wherewith the inventive installation enables the various above-mentioned disadvantages to be avoided while assuring a high production rate of ultrathin foil.

SUMMARY OF THE INVENTION

The installation which solves this problem is based on the use of anodes described in the above-mentioned Luxembourg Patent No. 86.119, herein incorporated by reference, along with a mobile cathode which moves while facing these anodes.

The inventive installation for manufacturing of an ultrathin metal foil by electrolyte deposition onto a moving cathode and eventual separation of the deposited material from the cathode is comprised of at least one anode having a plate perforated by a first series of orifices supplied with means of feed of electrolyte. The plate is also perforated by a second series of orifices which are supplied with means of evacuation of electrolyte. The invention is characterized in that:

(a) The moving cathode is comprised of a metallic belt extended taut between two parallel rolls, which rolls are preferably horizontal;

(b) At least one of the rolls is motorized so as to cause the belt to rotate around the two rolls;

(c) A first set of the anodes is disposed facing a portion of the length of a first longitudinal run of said belt;

(d) Means of electrical connection are provided from the plate of each anode of the first set to the positive terminal of a source of continuous D.C. current;

(e) Means of electrical connection are provided from the metallic belt to the negative terminal of the source of continuous D.C. current; and (f) Means are provided for regulating:

the speed of the metallic belt;

the rates of feed and removal of the electrolyte; and the intensity of the electric current.

According to other characteristics which can be included, the inventive apparatus comprises means of rinsing the ultrathin foil, and means of drying the foil which means are disposed upstream of the device for separating the foil from the moving cathode. The inventive apparatus can further comprise an installation to subject the foil to a treatment which would cause an increase in its carbon content.

According to the invention, the cathode is a titanium belt, preferably polished. The condition of the surface of the cathode has a strong effect on the removability and quality of the ultrathin foil produced. It is advantageous if the active surface of the cathode is as polished as possible. The "active surface" in the present context is the surface which receives the electrolytic deposit.

It has also been found to be advantageous if both the first and second roll, which are preferably horizontal, are equipped with drive motors.

According to a particularly interesting characteristic, the inventive apparatus is comprised of a second set of anodes, disposed facing a portion of the length of a second longitudinal run of the belt, wherewith the plates of the anodes are electrically connected to the positive terminal of a source of D.C. electrical current.

In an advantageous embodiment of the inventive apparatus, the first and second sets of anodes are disposed facing substantially equal portions of length of respective runs of the belt, the length segments extending from a first roll among the two horizontal rolls. The ensemble comprised of the first roll, the first and second sets of anodes, and the corresponding portions of the runs of the belt, namely, corresponding to the sets of anodes, is surrounded by a water-tight and air-tight enclosed tank. This is with the second roll being disposed outside of the enclosure of the enclosed tank, wherewith the entrance and exit locations of the belt to and from the tank are supplied with means which prevent passage of liquids.

According to the invention, at least one anode is comprised of a box having the shape of a parallelepiped of which the wall facing the cathode is comprised of an electrically conducting material, preferably graphite, and the other walls of the box are preferably comprised of an electrically insulating material which is also chemically inert to the electrolyte.

Also according to the invention, the means of electrically connecting an anode comprises copper bars connected to the plate of the anode, preferably on the two narrower sides or "width sides" of the plate.

According to another feature of the inventive apparatus, the means of electrical connection of the metallic belt comprise brushes, preferably immersed in the electrolyte.

Another feature of the inventive installation consists of rinsing means and drying means for the ultrathin metallic foil, comprised of apparatus for propelling water or air, respectively, toward the foil.

Other advantages and characteristics of the invention are set forth in the description which follows, of a particular embodiment of the inventive installation, with the aid of the attached schematic drawings. Analogous elements in different FIGS. have been given the same reference numerals. Components of the installation not essential to a good understanding of the invention have been omitted.

DETAILED DESCRIPTION OF THE INVENTION

Figure 1:
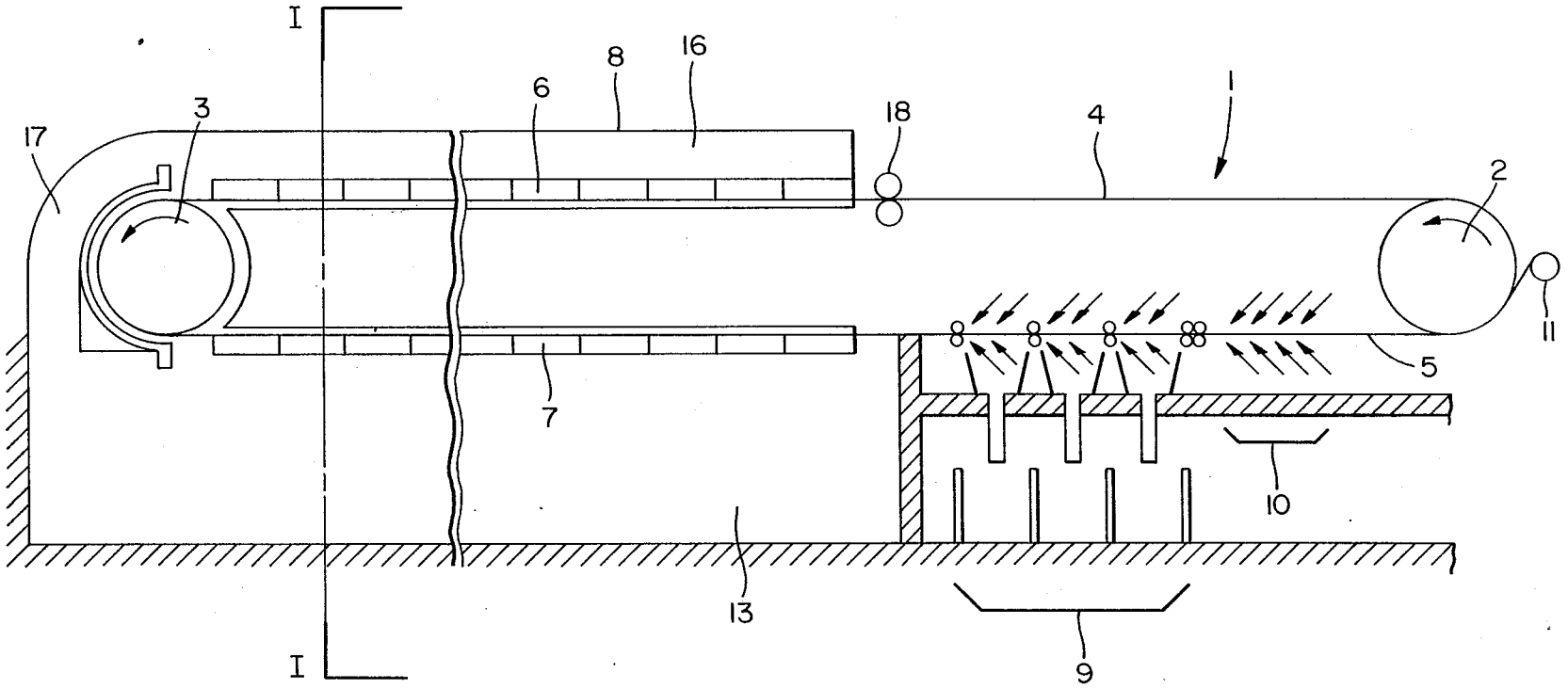
FIG. 1 is a general view of the inventive installation.

FIG. 1 is a general side view of a particular embodiment of the inventive installation. This installation is comprised of a moving cathode in the form of a metallic belt 1 extended taut between two parallel horizontal rolls 2 and 3. The edges of the belt 1 can be masked, on the anode side, by a coating or the like adequate to give the desired width to the ultrathin foil. The rolls are rotationally driven by motors, not shown. The direction of rotation is indicated by the curved arrows. The metallic belt 1 defines an upper run 4 which is the entrance run, explained below, and a lower or exit run 5. The installation also comprises anodes of the type described in Luxembourg Patent No. 86.119 cited above, wherein the wall perforated bY two series of orifices is a flat plate of graphite. These anodes are divided into two groups, an upper group 6 in which the anodes are positioned with their respective graphite plates opposite and parallel to the exterior face of the upper run 4 of the belt, and a lower group 7, in which the anodes are positioned such that their respective graphite plates are opposite and parallel to the exterior face of the lower run 5 of the belt.

With such an arrangement, the metallic belt 1 is only partially immersed in the electrolyte. Thus, one may regard the installation for manufacturing an ultrathin metallic foil as comprised of two distinct parts, described infra, despite the physical continuity of the belt 1.

The immersed part of the installation comprises part of the belt 1 which has a constant length, but which is constantly being "renewed" due to the movement of the belt, the two groups of anodes (6, 7), the roll 3, and the brushes supplying electric current to the cathode. The non-immersed part or air-contact part of the installation comprises the remainder of the belt 1, the roll 2, and the means of dewatering, e.g., squeezing through elastic rolls, rinsing, final drying, and separation of the ultrathin foil. In the embodiment illustrated in FIG. 1, the immersed part of the installation is surrounded by a hermetically sealed enclosure 8 which includes the entrance and exit seals of the belt.

Opposite the portion of the belt 1, which is momentarily located on the immersed roll 3, there is disposed a polarization electrode which enables elimination of any chemical attack by the electrolyte on the ultrathin foil during passage from the upper group of anodes 6 to the lower group 7. This arrangement also obviates fabrication of cylindrical anodes. The immersed roll 3 should have a diameter which is large enough to transmit an adequate torque to the belt for rotating same, and to minimize the risk of breakage of the belt by fatigue.

Electrolyte and electric current can be fed, to the anodes of the two groups mentioned, either individually or in cells comprised of two or more anodes. For clarity, the various types of feeds will be described, hereinbelow, with reference to a cell comprised of a single anode and part of the cathode.

Electric current is supplied to the anode of a cell by means which are known in the art. Namely, a set of copper bars connected to the two narrow sides of the graphite plate are used. This arrangement reduces ohmic losses in the graphite plate and minimizes current density variations which would tend to cause variations in the thickness of the deposit along the width of the belt.

Electric current is supplied to the cathode by brushes immersed in the electrolyte. These brushes are distributed over the immersed flat surfaces or the "interior surface" of the belt 1 facing the groups of anodes.

The fact that the brushes are immersed eliminates the need to provide sealing structures between the fixed pieces and the moving pieces. Also, the electrolyte serves as a lubricant, reducing the frictional force on the belt. Finally, the electrolyte reduces the contact resistance between the cathode and brushes, and thereby contributes to improved electrical efficiency of the installation.

The electrolyte circulation system is described with reference to FIG. 2. The non-immersed roll 2 has the same diameter as the immersed roll 3. It delivers one-half of the torque required for driving the belt, and provides a means of guiding the belt in the transverse direction.

In the inventive installation, the means of rinsing and/or drying the ultrathin metallic foil are disposed ahead of the apparatus for separating the foil from the belt 1. This arrangement allows the important and delicate operations of rinsing and/or drying to be carried out with the ultrathin foil adhering to the belt throughout. In this way, the risk of degradation or tearing of the foil is reduced.

The rinsing and drying apparatuses are known in the art. Dewatering rolls, not shown, comprised of rubber material are placed as close as possible to the exit from the enclosure 8. Rinsing means 9 is also provided, employing, e.g., hot water sprays. These can be followed by drying means 10, employing, e.g., hot or cold blown air.

The ultrathin foil is separated from the belt by means of a small motorized roll 11 disposed approximately at the elevation of the axis of rotation of the non-immersed roll 2.

Figure 2:
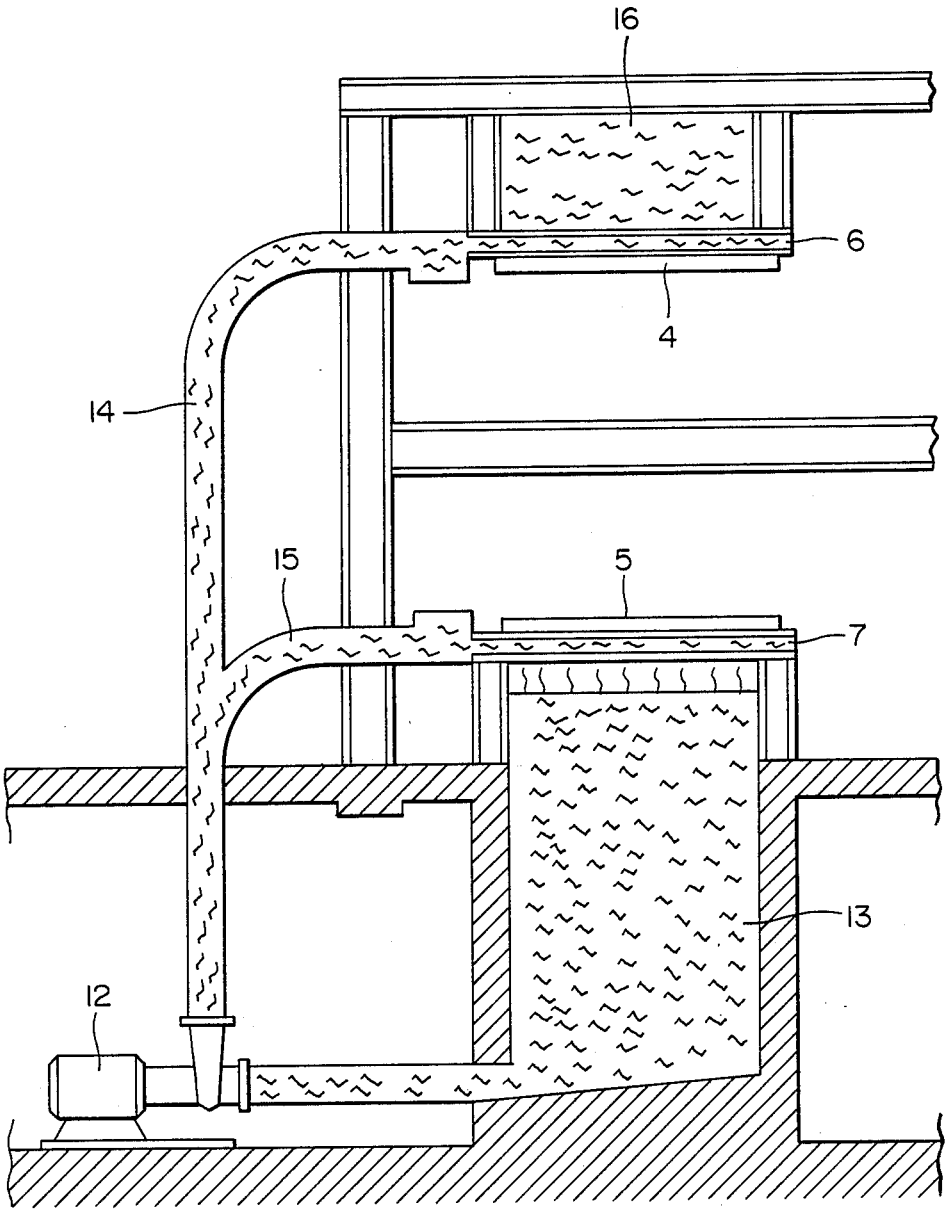
FIG. 2 illustrates the system of circulation of the electrolyte in the embodiment of FIG. 1.

FIG. 2 illustrates the circulation system for the electrolyte in an installation of the type represented in FIG. 1. As mentioned above, the system discussed is for the cell for a single anode site or "an anodic cell".

As disclosed in Luxembourg Patent No. 86.119 cited above, the electrolyte passes through the graphite plate of the cell via a first set of orifices. It then goes through a short path between the cathode and the plate. Then it returns through the same graphite plate, but in the opposite direction. The structure of this arrangement is not illustrated in detail in FIG. 2. It can be recalled that this type of anode enables one to eliminate lateral seals, because there is virtually no flow of electrolyte which is forced in the lateral direction.

FIG. 2 results from a transverse cross section of FIG. 1 at line 1—1. The upper run 4 and lower run 5 of the belt are shown schematically, along with a graphite plate of one anode from the upper group 6 and a graphite plate of an anode from the lower group 7.

To produce, at high current density, an ultrathin metallic foil having good surface appearance and sufficient cohesion, substantial specific throughputs of electrolyte must be achieved in the open space formed between the anode and cathode. The exemplary installation has an electrolyte circulation system with low loss of charge. Each pair of superposed cell chambers, the top chamber associated with the upper group of electrodes (4, 6) and the bottom chamber associated with the lower group of electrodes (5, 7), has electrolyte fed to it by a pump 12 which draws the liquid from a sump 13 and delivers it to conduits (14, 15) which feed the first set of orifices of the anodes 6 and 7, respectively.

As shown in FIG. 1, the sump 13 is disposed directly below the lower group 7 of anodes and extends at least over the entire length of the immersed part of the installation. The electrolyte drawn out and passed through the rear face of the cell chamber of the upper group of cell chambers 6, i e., through the upper anodes 6, is collected in a channel 16 of large cross section which extends over the entire length of the immersed part of the installation and which delivers the electrolyte to the sump 13 via a cascade 17 which passes around the immersed roll 3 of FIG. 1. At the entrance of the immersed part, the installation also comprises gripping rolls 18 which resist twisting of the belt 1 in the deposition section.

The inventive apparatus can advantageously be equipped with means whereby, after separation of an iron-based foil from the moving cathode, the iron-based foil is subjected to a treatment to increase its carbon content. According to the invention, this treatment is advantageously comprised of an operation of gaseous carburizing.

It has been found that such a gaseous carburizing treatment is of particular interest for increasing the carbon content of an iron-based foil produced by electrolytic deposition. Tests have shown, completely unexpectedly, that the speed of carburizing of such a foil is very high if the conditions of treatment are judiciously chosen. This high speed of carburizing which can be attributed to the initial purity of the foil, enables the degree of carburization desired to be achieved in a very short time. This makes the carburizing process suitable for a continuous fabrication operation.

According to the invention, the means of applying the carburizing treatment comprises a heating furnace for heating the foil to a temperature between 900° C. and 1050° C. under a carburizing atmosphere. It also has a zone for maintaining this temperature range under the carburizing atmosphere for a period not exceeding 5 minutes. A cooling zone is included for cooling at a rate of 5° C.-2O° C./sec. in the temperature interval 800° C.-6OO° C. This is followed by a cooling zone for cooling to ambient temperature.

For this treatment, a furnace with carburizing atmosphere is employed. This atmosphere is, per se, known and comprises, e.g., $CH_4$ or a mixture of gases rich in $CH_4$ and/or CO and $H_2$.

The scope of the invention also includes at least one device in the installation. This device covers the foil with a metallic protective coating and comprises a flash heating stage to cause formation of an intermediate layer of intermetallic alloy between the foil and the protective layer.

Finally, the variant of an inventive apparatus as described above can be equipped with means to coat the foil with a protective surface layer or film comprised of an oxide such as chromium oxide or an organic substance such as a paint, a plastic resin, or a varnish.

Figure 3:
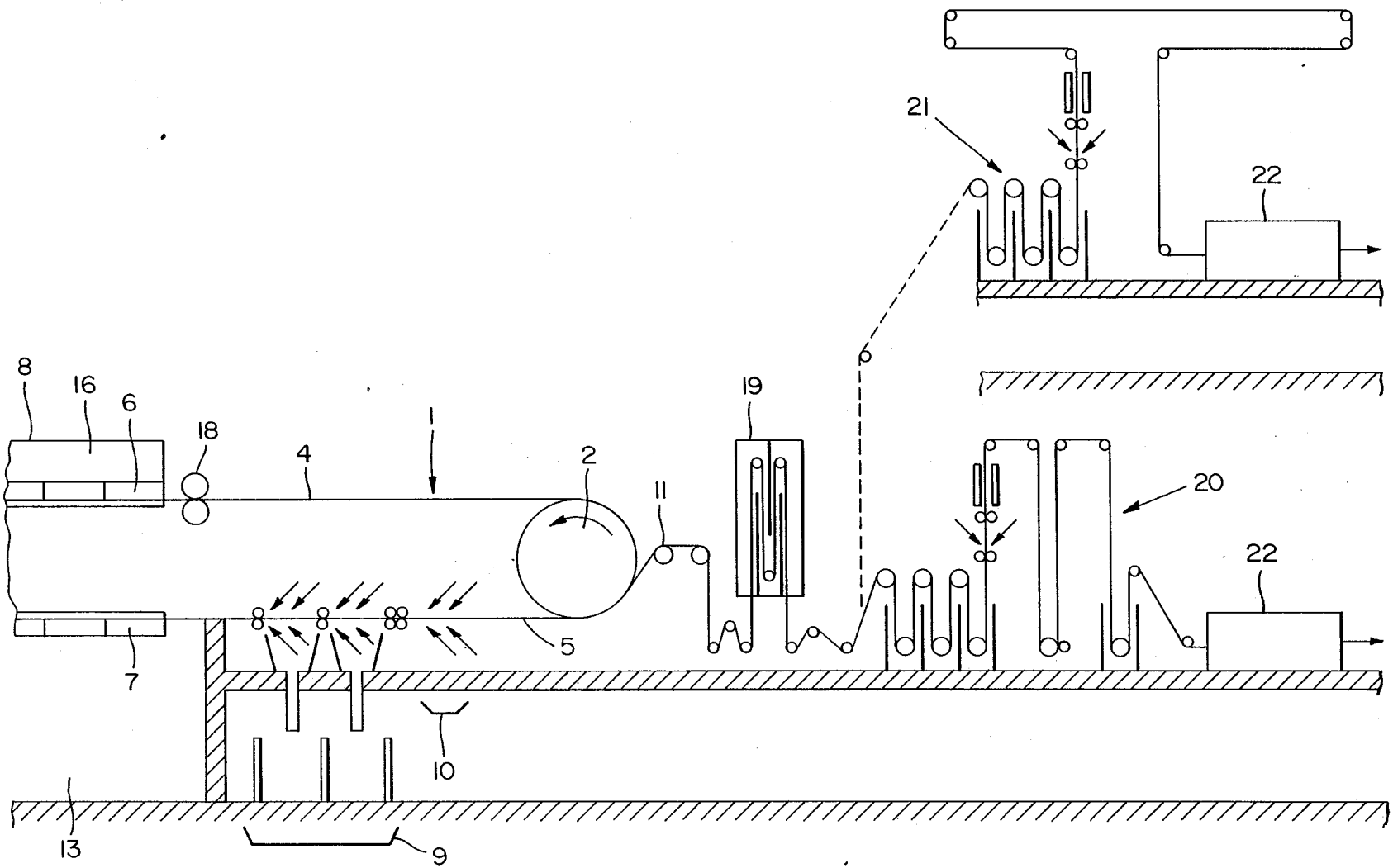
FIG. 3 illustrates a variant of the installation which also includes a carburizing device.

FIG. 3 illustrates a variant of the installation of FIG. 1 wherein a device is provided for carburizing the ultrathin metallic foil after the foil has been separated from the moving cathode.

A device 19 is disposed downstream of the installation 1 described in detail, supra. This device is for increasing the carbon content of the ultrathin foil. In the embodiment illustrated here, the device 19 is comprised of a gaseous carburizing furnace wherein the ultrathin foil is exposed to a carburizing atmosphere, e.g., comprising $CH_4$, at an elevated temperature.

The device 19 can be followed by coating apparatuses such as a wet galvanizing facility 20 or a tin plating facility 21. Finally, a finishing apparatus 22 can be installed downstream, e.g., for applying a protective layer by chromating, painting, or other process.

The apparatuses 20, 21, and 22 are, per se, known in the art and do not require detailed description. It should be noted, however, that the tensile force in these apparatuses should be limited, because of the relatively low tensile strength of the ultrathin foil.

We claim:

1. An installation for manufacturing an ultrathin foil by electrolytic deposition onto a moving cathode, with subsequent separation of a deposited material from said cathode, said installation including at least one anode having a plate perforated with a first series of orifices connected to means for feeding of electrolyte, said plate being perforated with a second series of orifices supplied with means for evacuating electrolyte, comprising:

(a) a metallic belt of said moving cathode being extended taut between two parallel rolls, at least one of said rolls being motorized so as to cause said belt to rotate around said two rolls;

(b) a first set of said anodes being disposed facing a portion of a length of a first longitudinal run of said belt;

(c) means of electrical connection being provided from said plate of each anode of said first set of anodes to a positive terminal of a source of continuous d.c. current;

(d) means of electrical connection being provided from said metallic belt to a negative terminal of said source of continuous d.c. current; and (e) means for regulating:

the speed of said metallic belt;

rates of feed and removal of said electrolyte; and intensity of said electric current.

2. The installation according to claim 1 further comprising means for rinsing and/or drying said ultrathin foil, said means being disposed upstream of an apparatus whereby said foil is separated from said moving cathode.

3. The installation according to claim 1 wherein said cathode is comprised of a belt comprised of titanium material.

4. The installation according to claim 1 further comprising a second set of anodes being disposed facing a portion of a length of a second longitudinal run of said belt, wherewith the plates of said anodes are electrically connected to the positive terminal of a source of continuous d.c. current.

5. An installation according to claim 4 wherein said first and second sets of anodes are disposed facing substantially equal portions of length of respective runs of said belt, said length segments extending from a first roll among said two rolls, said rolls being horizontal and wherein said first roll, said first and second sets of anodes, and corresponding portions of said runs of said belt are surrounded by a sealed enclosed tank; and wherein said second roll is disposed outside of said enclosure of said enclosed tank and entrance and exit locations of said belt to and from said tank are supplied with means for preventing passage of liquids.

6. The installation according to claim 1 wherein at least one of said anodes is comprised of a box having a shape of a parallelepiped of which a wall facing said cathode is comprised of an electrically conducting material and other walls of said box are comprised of an electrically insulating material which is also chemically inert to said electrolyte.

7. The installation according to claim 1 wherein said means of electrically connecting an anode comprises copper bars connected to said plate of said anode onto narrower width sides of said plate.

8. The installation according to claim 1 wherein said means of electrical connection of said metallic belt comprise brushes immersed in the electrolyte.

9. The installation according to claim 1 wherein said installation is equipped with treatment means for increased a carbon content of said ultrathin metallic foil.

10. The installation according to claim 1 wherein at least one apparatus is provided for coating said foil with a protective layer.

11. The installation according to claim 11 wherein said metallic belt is horizontal.

12. The installation according to claim 6 wherein said electrically conducting material is graphite.

* * * * *